US006956552B2

(12) United States Patent
Yu

(10) Patent No.: US 6,956,552 B2
(45) Date of Patent: Oct. 18, 2005

(54) METHOD AND APPARATUS FOR DRIVING A DISPLAY

(75) Inventor: Jian-Shen Yu, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 343 days.

(21) Appl. No.: 10/294,164

(22) Filed: Nov. 14, 2002

(65) Prior Publication Data

US 2004/0008169 A1 Jan. 15, 2004

(30) Foreign Application Priority Data

Jul. 15, 2002 (TW) ..... 91115735 A

(51) Int. Cl.[7] ..... G09G 3/36
(52) U.S. Cl. ..... 345/92; 345/98; 345/100
(58) Field of Search ..... 345/92, 98, 100

(56) References Cited

U.S. PATENT DOCUMENTS 5,526,012 A * 6/1996 Shibahara ..... 345/92
5,940,055 A * 8/1999 Lee ..... 345/87
6,417,829 B1 * 7/2002 Jung et al. ..... 345/98

* cited by examiner

*Primary Examiner*—Richard Hjerpe
*Assistant Examiner*—Ke Xiao
(74) *Attorney, Agent, or Firm*—Fish & Richardson P.C.

(57) ABSTRACT

A method for driving a display having display cells with capacitors coupled to gate lines. The method comprises the steps of floating the gates of the transistors of the Nth and (N+1)th display cell, applying a high voltage level to the gate of the transistor of the Nth display cell to turn it on and keeping the gate of the transistor of the (N+1)th display cell floated, applying a low voltage level to the gate of the transistor of the Nth display cell to turn it off and the first voltage level to the gate of the transistor of the (N+1)th display cell to turn it on, and floating the gate of the transistor of the Nth display cell and applying the low voltage level to the gate of the transistor of the (N+1)th display cell to turn it off.

8 Claims, 5 Drawing Sheets

METHOD AND APPARATUS FOR DRIVING A DISPLAY

CROSS REFERENCE TO RELATED APPLICATIONS

Pursuant to 35 U.S.C. § 119, this application claims the benefit of Taiwan Patent Application Number 91115735, filed Jul. 15, 2002

BACKGROUND OF THE INVENTION

1. Field of the Invention

The present invention relates to a method and apparatus for driving a display, and particularly to a method and apparatus for driving a display having display cells with storage capacitors coupled to gate lines.

2. Description of the Prior Art

FIG. 1 is a diagram showing a portion of a conventional display driving circuit. A scan driver 11 provides gate signals GS to display cells 12 for pixel scanning. The display cells 12 receive pixel data carried by data signals DATA from a data driver (not shown) during scan periods. As the display cells 12 are scanned row by row, the pixel data of each frame is stored into the display cells.

The (N+1)th display cell 12 comprises a transistor 121, a liquid crystal cell 122 and a storage capacitor 123. The transistor 121 has a gate coupled to receive the (N+1)th gate signal (N+1)th GS, a drain coupled to receive the data signal DATA and a source coupled to one end of the liquid crystal cell 122. The other end of the liquid crystal cell 122 is coupled to a common electrode (not shown) receiving a common signal Vcom. The storage capacitor 123 has two ends respectively coupled to the source of the transistor 121 and to receive the Nth gate signal Nth GS.

FIG. 2 is a diagram showing timing of the signals of the conventional display driving circuit in FIG. 1. The signal Vcom is an AC signal swinging between voltage levels V1 and V0. Each transistor of the display cells 12 is turned on when the scan driver 11 outputs a high-level gate voltage signal VGH as the gate signal GS and turned off when the scan driver 11 outputs a low-level gate voltage signal VGL as the gate signal GS. Since each of the capacitors 123 is coupled to the gate line of a previous row of the display cells 12, it is necessary for the low-level gate voltage signal VGL to swing with the common signal Vcom in order to maintain a proper voltage difference across the liquid crystal cell 122. The low-level gate voltage signal VGL must be an AC signal swinging between voltage levels V3 and V4 wherein (V3–V4)=(V1–V0). As a result, the gate signal GS is a three-state signal swinging among the voltage levels V2, V3 and V4 wherein V2>V3>V4.

However, the power consumption of the driving circuit using an AC signal as the low-level gate voltage signal VGL is much higher than that using a DC signal.

SUMMARY OF THE INVENTION

The object of the present invention is to provide a method and apparatus for driving a display having display cells with Vcom swing and storage capacitors coupled to gate lines, wherein a DC signal is used as the low-level gate voltage signal to reduce the power consumption.

The present invention provides a method for driving a display having a first and second display cell, each of which comprises a transistor and capacitor, the capacitor of the second display cell coupled to a gate of the transistor of the first display cell. The method comprises the steps of floating the gates of the transistors of the first and second display cell, applying a first voltage level to the gate of the transistor of the first display cell to turn on the transistor of the first cell and keeping the gate of the transistor of the second display cell floated, applying a second voltage level to the gate of the transistor of the first display cell to turn off the transistor of the first display cell and the first voltage level to the gate of the transistor of the second display cell to turn on the transistor of the second display cell, and floating the gate of the transistor of the first display cell and applying the second voltage level to the gate of the transistor of the second display cell to turn off the transistor of the second display cell.

The present invention further provides an apparatus for driving a display having a first and second display cell, each of which comprises a transistor and capacitor, the capacitor of the second transistor coupled to a gate of the transistor of the first display cell. The apparatus comprises a first and second gate signal generator, each of which has a first and second input terminal, and a gate signal output terminal, the first input terminal of the first gate signal generator receiving a first pulse train, the second input terminal of the first gate signal generator and the first input terminal of the second gate signal generator commonly receiving a second pulse train, the second input terminal of the second gate signal generator receiving a third pulse, and the gate signal output terminals of the first and second gate signal generator coupled to gates of the transistors of the first and second display cell respectively.

Thus, in the present invention, gate signal generators output the high-level gate voltage signal as the gate signal to the display cells in the scan periods but float the gate of the transistors of the display cells beyond the scan period. The low-level gate voltage signal needs not swing with the common signal, which reduces the power consumption of the driving circuit.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE INVENTION

Figure 1:
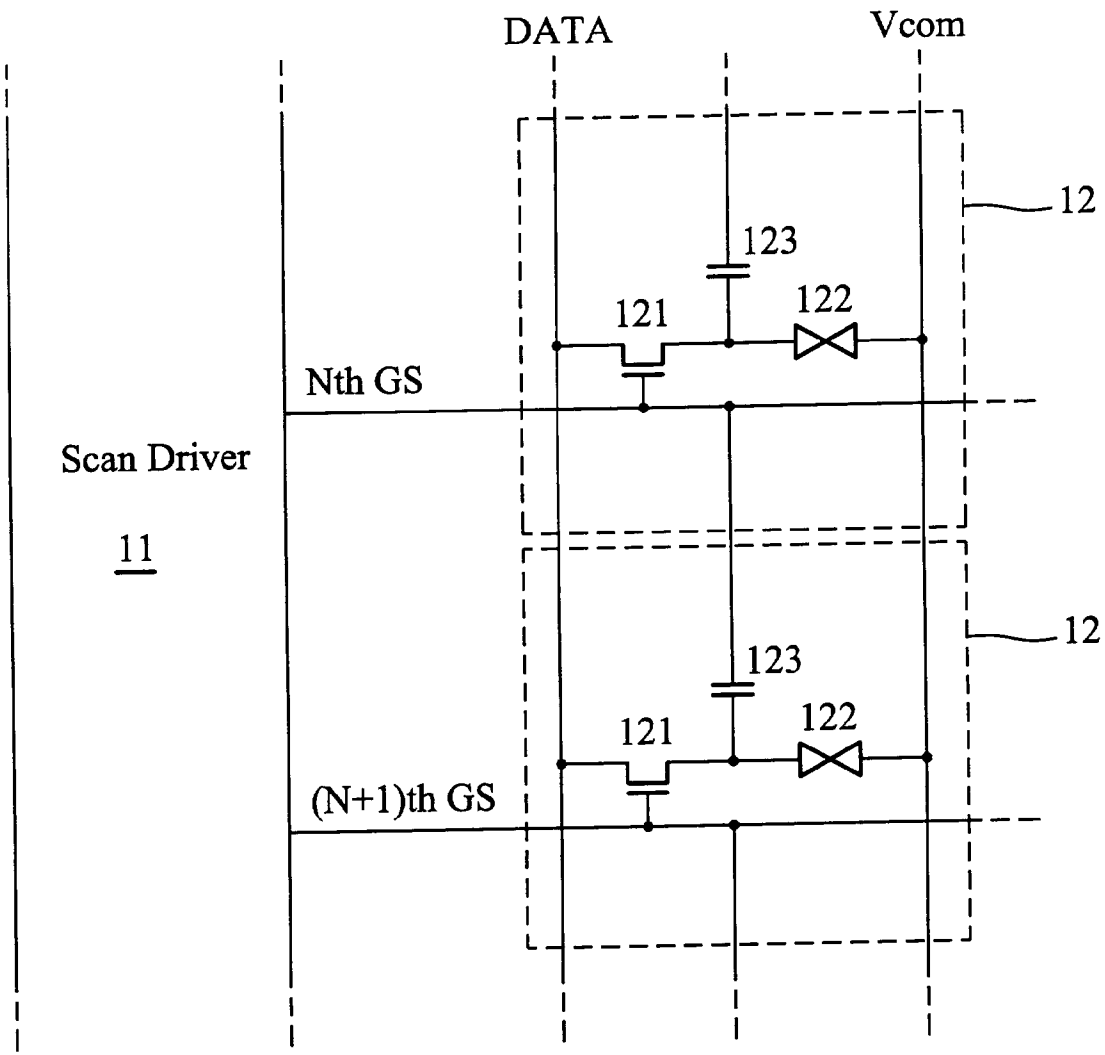
FIG. 1 ( PRIOR ART )
FIG. 1 is a diagram showing a portion of a conventional display driving circuit.
Figure 3:
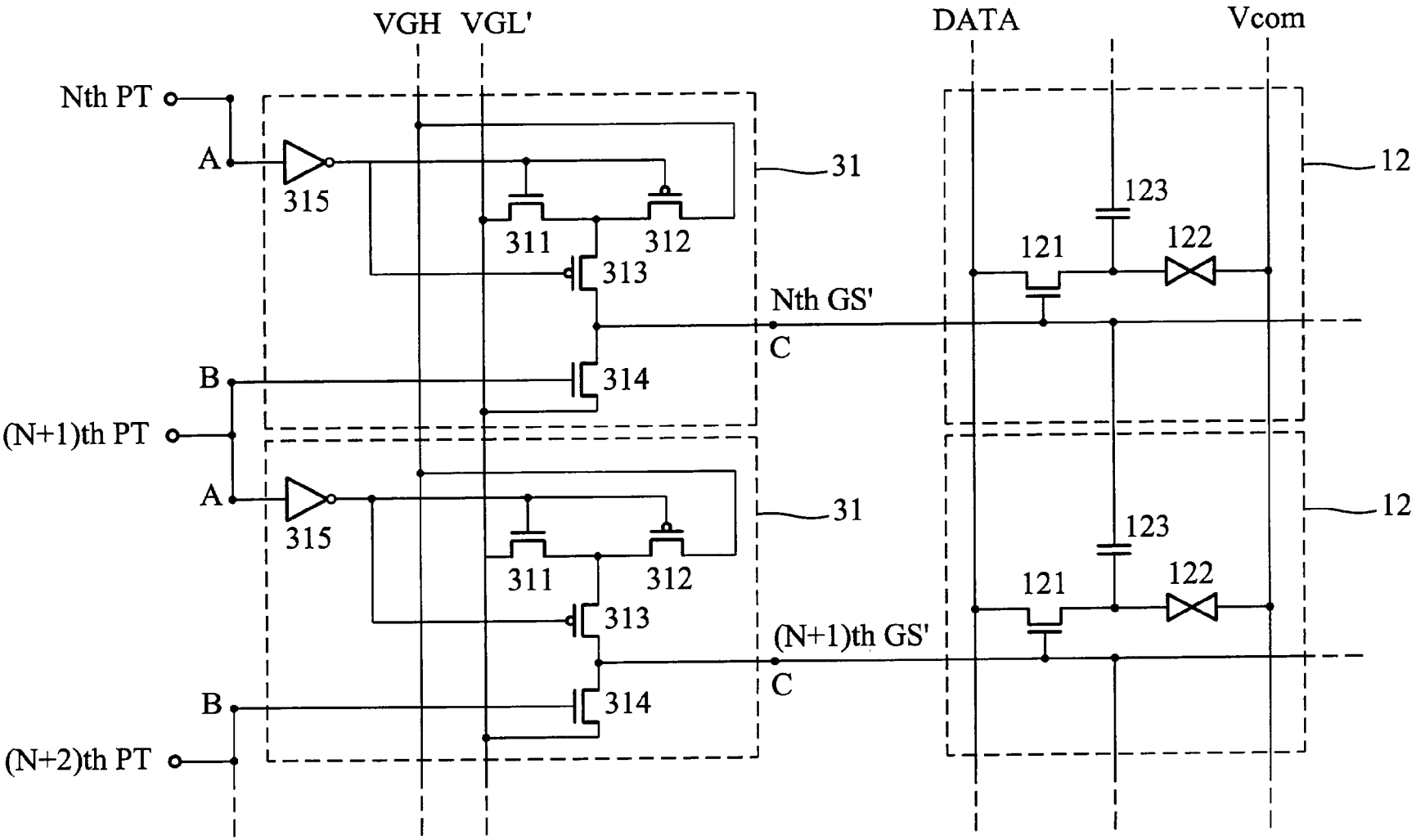
FIG. 3 is a diagram showing a display driving circuit according to one embodiment of the invention.

FIG. 3 is a diagram showing a portion of a display driving circuit according to one embodiment of the invention. The same elements in FIG. 1 and FIG. 3 refer to the same symbols for clarity. FIG. 3 shows the Nth and (N+1)th display cell for example. Each of the display cells 12 comprises a transistor 121, a liquid crystal cell 122 and a storage capacitor 123. The transistor of the Nth display cell 12 has a gate coupled to receive the Nth gate signal Nth GS, a drain coupled to receive a data signal DATA and a source coupled to one end of the liquid crystal cell 122. Similarly, the transistor of the (N+1)th display cell 12 has a gate coupled to receive the (N+1)th gate signal (N+1)th GS, a drain coupled to receive the data signal DATA and a source coupled to one end of the liquid crystal cell 122. All the other ends of the liquid crystal cells 122 are commonly coupled to a common electrode (not shown) receiving a common signal Vcom. The common signal Vcom is an AC signal swinging between voltage levels V1 and V0. The capacitor of each display cell 12 is coupled between the gate line for the previous row of the display cells and the source of the transistor 121.

The driving circuit further comprises gate signal generators 31, each of which corresponds to one of the display cells 12 and has input terminals A and B, and a gate signal output terminal C. The input terminal A of the Nth gate signal generator 31 receives the Nth pulse train Nth PT from a shift register (not shown). The input terminal B of the Nth gate signal generator 31 and the input terminal A of the (N+1)th gate signal generator 31 commonly receive the (N+1)th pulse train (N+1)th PT. The input terminal B of the (N+1)th gate signal generator 31 receives the (N+2)th pulse train (N+2)th PT. The gate signal output terminals C of the Nth and (N+1)th gate signal generator 31 are coupled to the gates of the transistors 121 of the Nth and (N+1)th display cell respectively.

Each gate signal generator 31 comprises an inverter 315, N-type transistor 311 and 314, P-type transistor 312 and 313. The inverter 315 has an input terminal coupled to the input terminal A. The transistor 311 has a gate coupled to an output terminal of the inverter 315 and a source coupled to receive a low-level gate voltage signal VGL'. The transistor 312 has a gate coupled to the output terminal of the inverter 315, a drain coupled to the source of the transistor 311 and a source coupled to receive a high-level gate voltage signal VGH. The transistor 313 has a gate coupled to the output terminal of the inverter 315, a drain coupled to the gate signal output terminal C and a source coupled to a drain of the transistor 311. The transistor 314 has a gate coupled to the input terminal B, a drain coupled to the gate signal output terminal C and a source coupled to receive the low-level gate voltage signal VGL'.

Figure 2:
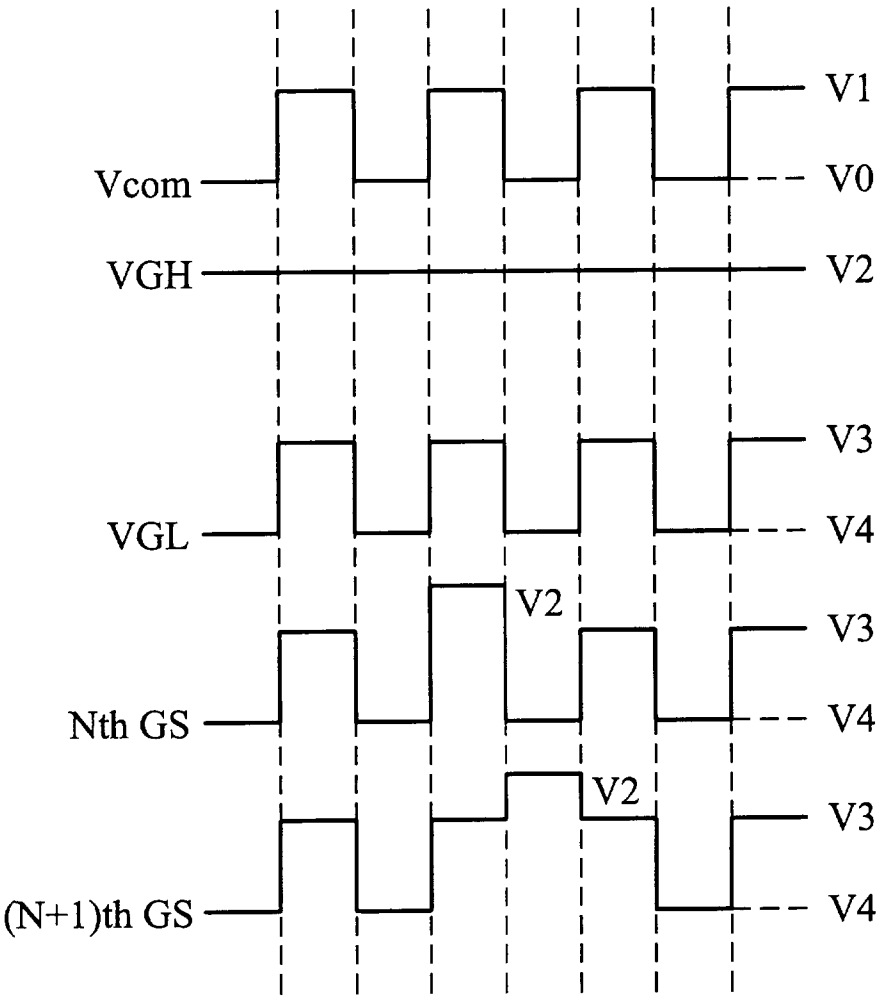
FIG. 2 ( PRIOR ART )
FIG. 2 is a diagram showing the timing of the signals used in the conventional display driving circuit.
Figure 4:
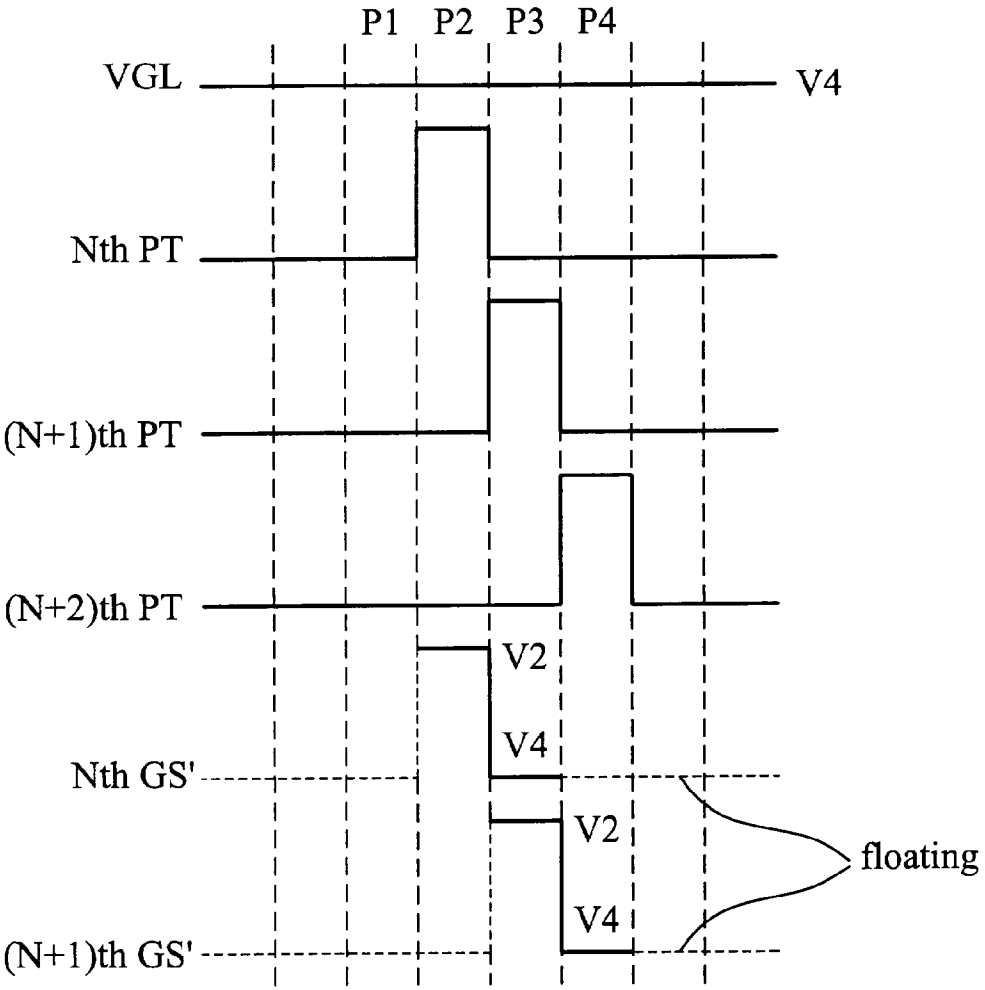
FIG. 4 is a diagram showing the timing of the signals used in the display driving circuit of FIG. 3.

FIG. 4 is a diagram showing the timing of the signals used in the driving circuit of FIG. 3. The signal Vcom is not shown in FIG. 4 since it is the same as that shown in FIG. 2.

In the period P1, all the Nth, (N+1)th and (N+2)th pulse trains Nth, (N+1)th and (N+2)th PT have a low voltage level so that the transistors 313 and 314 of the Nth and (N+1)th gate signal generators 31 are turned off and their gate signal output terminals C are floated.

In the period P2, the Nth, (N+1)th and (N+2)th pulse train Nth, (N+1)th and (N+2)th PT respectively has a high, low and low voltage level so that the transistors 312 and 313 of the Nth gate signal generator are turned on and the transistors 313 and 314 of the (N+1)th gate signal generator are turned off. The Nth gate signal Nth GS has a voltage level V2 derived from the high-level gate voltage signal VGH and the (N+1)th gate signal (N+1)th GS is floating.

In the period P3, the Nth, (N+1)th and (N+2)th pulse train Nth, (N+1)th and (N+2)th PT respectively have the low, high and low voltage level so that the transistors 313 and 314 of the Nth gate signal generator 31 are respectively turned off and on, and the transistors 312 and 313 of the (N+1)th gate signal generator 31 are turned on. The Nth gate signal Nth GS has a voltage level V4 derived from the low-level gate voltage signal VGL' and the (N+1)th gate signal (N+1)th GS has the voltage level V2 derived from the high-level gate voltage signal VGH.

In the period P4, the Nth, (N+1)th and (N+2)th pulse train Nth, (N+1)th and (N+2)th PT respectively have the low, low and high voltage level so that the transistors 313 and 314 of the Nth gate signal generator 31 are turned off, and the transistors 313 and 314 of the (N+1)th gate signal generator 31 are respectively turned off and on. The Nth gate signal Nth GS is floating and the (N+1)th gate signal (N+1)th GS has the voltage level V4 derived from the low-level gate voltage signal VGL'.

Since the gate line for each display cell has a fixed voltage level only during its scan periods and is kept floating beyond the scan periods, the low-level gate voltage signal VGL' needs not swing with the common signal Vcom, which reduces power consumption.

Figure 5:
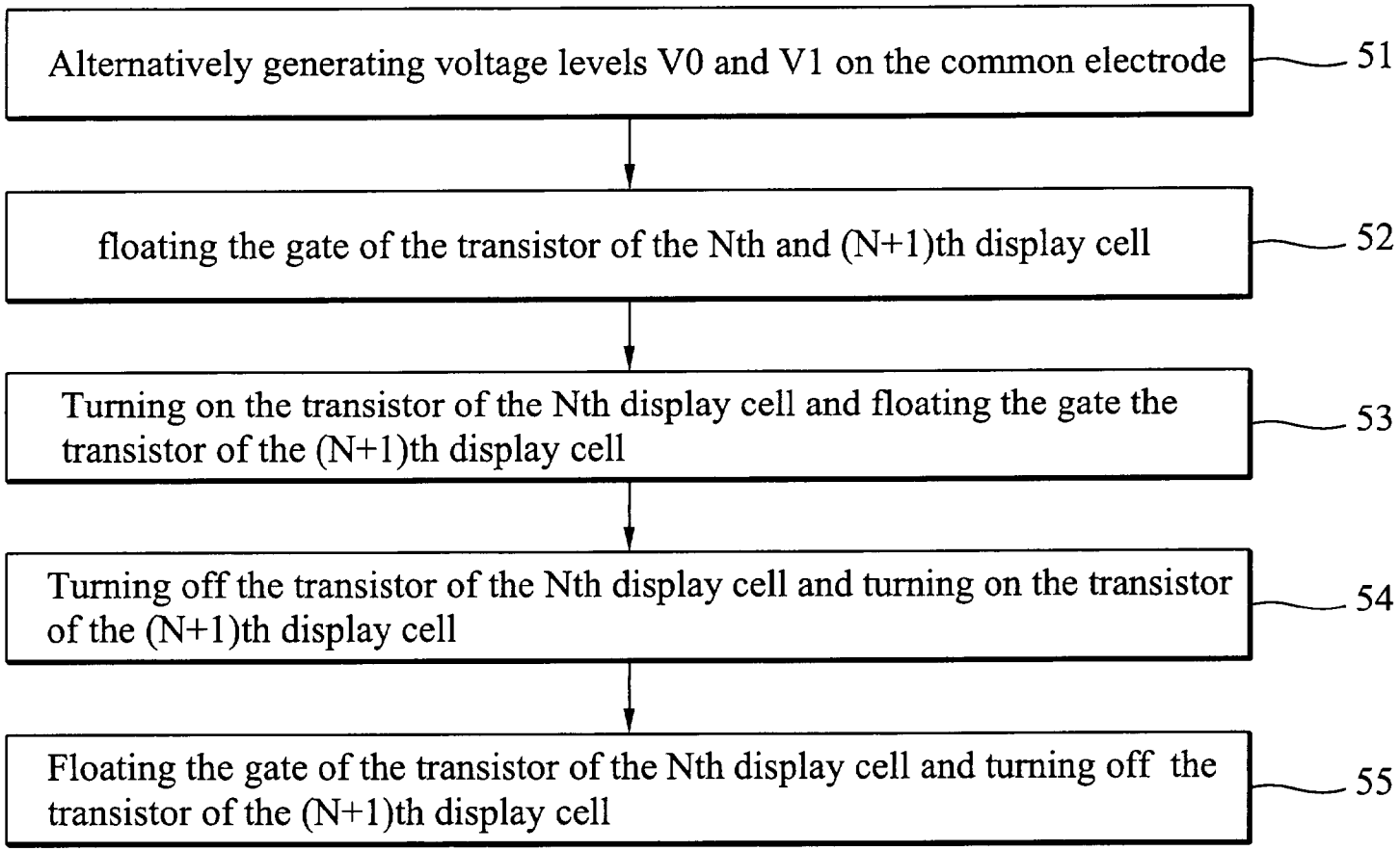
FIG. 5 is a flowchart of a method for driving a display according to one embodiment of the invention.

FIG. 5 is a flowchart of a method for driving a display according to one embodiment of the invention.

In step 51, the voltage levels V1 and V0 are alternatively applied to the common electrode. The voltage level V1 is between the voltage levels V0 AND V2.

In step 52, the gates of the transistors of the Nth and (N+1)th display cell are floated.

In step 53, The voltage level V2 is applied to the gate of the transistor of the Nth display cell to turn it on and the gate of the transistor of the (N+1)th display cell is kept floating.

In step 54, the voltage level V0 is applied to the gate of the transistor of the Nth display cell to turn it off and the voltage level V2 is applied to the gate of the transistor of the (N+1)th display cell to turn it on.

In step 55, the gate of the transistor of the Nth display cell is floated and the voltage level V0 is applied to the gate of the transistor of the (N+1)th display cell to turn it off.

In conclusion, the present invention provides a method and apparatus for driving a display having display cells with Vcom swing and storage capacitors coupled to gate lines. Gate signal generators output the high-level gate voltage signal as the gate signal to the display cells in the scan periods but float the gate of the transistors of the display cells beyond the scan period. The low-level gate voltage signal needs not swing with the common signal, which reduces the power consumption of the driving circuit.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A method for driving a display having a first and second display cell, each of which comprises a transistor and capacitor, the capacitor of the second display cell being coupled to a gate of the transistor of the first display cell, the method comprising the steps of:

floating the gates of the transistors of the first and second display cell;

applying a first voltage level to the gate of the transistor of the first display cell to turn on the transistor of the first cell and keeping the gate of the transistor of the second display cell floated;

applying a second voltage level to the gate of the transistor of the first display cell to turn off the transistor of the first display cell and the first voltage level to the gate of the transistor of the second display cell to turn on the transistor of the second display cell; and floating the gate of the transistor of the first display cell and applying the second voltage level to the gate of the transistor of the second display cell to turn off the transistor of the second display cell.

2. The method as claimed in claim 1, wherein each of the transistors of the first and second display cell has a drain coupled to receive a data signal and the capacitor of the second display cell is coupled between a source of the transistor of the second display cell and the gate of the transistor of the first display cell.

3. The method as claimed in claim 2, wherein each of the first and second display cells further comprises a liquid crystal cell controlled by a voltage difference between a common electrode and the source of the transistor.

4. The method as claimed in claim 3 further comprising the steps of: alternatively applying the first voltage level and a third voltage level between the first and second voltage level to the common electrode.

5. An apparatus for driving a display having a first and second display cell, each of which comprises a transistor and capacitor, the capacitor of the second transistor being coupled to a gate of the transistor of the first display cell, the apparatus comprising:

a first and second gate signal generator, each of the first and second gate signal generators comprising:

a first and second input terminal, and a gate signal output terminal, the first input terminal of the first gate signal generator receiving a first pulse train, the second input terminal of the first gate signal generator and the first input terminal of the second gate signal generator commonly receiving a second pulse train, the second input terminal of the second gate signal generator receiving a third pulse, and the gate signal output terminals of the first and second gate signal generators coupled to gates of the transistors of the first and second display cells respectively;

an inverter having an input terminal coupled to the first input terminal;

a first transistor of a first type having a gate coupled to an output terminal of the inverter and a source coupled to receive a first voltage;

a second transistor of a second type having a gate coupled to the output terminal of the inverter, a drain coupled to the source of the first transistor and a source coupled to receive a second voltage;

a third transistor of the second type having a gate coupled to the output terminal of the inverter, a drain coupled to the gate signal output terminal and a source coupled to a drain of the first transistor; and a fourth transistor of the first type having a gate coupled to the second input terminal, a drain coupled to the gate signal output terminal and a source coupled to receive the first voltage.

6. The apparatus as claimed in claim 5, wherein each of the transistors of the first and second display cell has a drain coupled to receive a data signal and the capacitor of the second display cell is coupled between a source of the transistor of the second display cell and the gate of the transistor of the first display cell.

7. The apparatus as claimed in claim 6, wherein each of the first and second display cell further comprises a liquid crystal cell controlled by a voltage difference between a common electrode and the source of the transistor.

8. The apparatus as claimed in claim 7, wherein the common electrode is alternatively applied to the first voltage level and a third voltage level between the first and second voltage level.

* * * * *